US005382389A

United States Patent [19]

Goodine et al.

[11] Patent Number: 5,382,389

[45] Date of Patent: Jan. 17, 1995

[54] FOAM PRODUCING VENTURI AND METHOD OF USING SAME

[76] Inventors: Allen Goodine, Aroostook, New Brunswick, E0J 1B0; Robert J. Goodale, Perth-Andover, New Brunswick, E0J 1V0, both of Canada

[21] Appl. No.: 140,532

[22] Filed: Oct. 25, 1993

[30] Foreign Application Priority Data

Sep. 20, 1993 [CA] Canada ..... 2106526

[51] Int. Cl.[6] ..... B01F 3/04

[52] U.S. Cl. ..... 261/18.1; 261/78.2; 261/DIG. 46; 169/15

[58] Field of Search ..... 261/18.1, 78.2, DIG. 46; 169/15

[56] References Cited

U.S. PATENT DOCUMENTS

| | | | |
|---|---|---|---|
| 2,146,605 | 2/1939 | Timpson | 169/15 |
| 2,492,037 | 12/1949 | Freeman et al. | 261/DIG. 26 |
| 2,645,292 | 7/1953 | Williams | 261/DIG. 26 |
| 2,826,399 | 3/1958 | Eriksson | 261/DIG. 26 |
| 2,889,999 | 6/1959 | Tomlinson | 239/431 |
| 2,941,729 | 6/1960 | Goodrie | 239/430 |
| 3,419,082 | 12/1968 | O'Regan et al. | 261/DIG. 26 |
| 3,424,250 | 1/1969 | Thomae | 169/15 |
| 4,026,474 | 5/1977 | Knauer et al. | 239/430 |
| 4,796,814 | 1/1989 | Klemm et al. | 239/430 |
| 4,830,790 | 5/1989 | Stevenson | 261/18.1 |
| 4,968,458 | 11/1990 | Besnia | 261/78.1 |
| 5,054,688 | 10/1991 | Grindley | 169/15 |

FOREIGN PATENT DOCUMENTS

| | | | |
|---|---|---|---|
| 583153 | 9/1959 | Canada | 169/15 |
| 54162 | 3/1943 | Netherlands | 261/DIG. 26 |
| 491838 | 9/1938 | United Kingdom | 261/DIG. 26 |
| 0665920 | 6/1979 | U.S.S.R. | 169/15 |
| 1003855 | 3/1983 | U.S.S.R. | 169/15 |

*Primary Examiner*—Tim Miles

*Attorney, Agent, or Firm*—McFadden, Fincham

[57] ABSTRACT

A venturi for producing medium expansion foam for use in fire fighting applications. The new venturi contains a swirl inducer bushing near the entry of the nozzle, a two section frustum shaped diffuser, and a plurality of angularly oriented air injector openings. The venturi progressively decreases in cross-sectional area from a discharge point thereof to a throat of the nozzle. The cross-sectional design together with orientation of the air injector permits high quality lasting foam to be produced under a broad fluid supply pressure while minimizing the amount of foam reagent employed.

26 Claims, 3 Drawing Sheets

FOAM PRODUCING VENTURI AND METHOD OF USING SAME

FIELD OF THE INVENTION

The present invention relates to foam generating nozzles suitable for use in fire fighting or related applications. More particularly, the invention relates to a medium expansion foam venturi for producing a blanket of high density bubble structure having a long drain time, and being especially efficient in suffocating stagnant fires.

BACKGROUND OF THE INVENTION

Medium expansion foams are generally used to quench burning root system following a forest fire, to extinguish grass fires, to apply fire barrier blanket strips around buildings and wood structures such as bridges and towers, and to extinguish car fires by rapidly filling the vehicle with high volume foam.

Fire fighting foam is produced by expanding a fluid, usually water mixed with a foaming agent, through a nozzle, and by introducing air into the expanding spray.

The science of thermodynamics teaches that a nozzle consists of a throat region having an opening area smaller than the area of the supply conduit. A nozzle also consists of a convergent section at the entry of the throat, and may have a divergent section following the throat.

Such nozzle is used primarily to reduce the pressure of a fluid, to increase its velocity, and, of pertinent importance, to increase the specific volume of the fluid.

The efficiency in expanding a fluid through a nozzle is directly related to a suitable combination of an area ratio: (exit area/throat area) and a pressure ratio: (discharge pressure/throat pressure).

Along the same line of teaching, an elongated divergent section following a nozzle is generally known as a diffuser. A diffuser tends to reduce the velocity of the fluid and increases its discharge pressure. The combination of convergent nozzle and diffuser is known in the art as a venturi.

Furthermore, in fluid dynamics, an injector generally functions as a device which uses the kinetic energy of one fluid to pump another fluid from a region of lower pressure.

The region of lower pressure for placement of an air injector in a foam nozzle being as close as possible from the discharge side of the throat, the pressure gradient through the diffuser is directly proportional to the efficiency of the injector. The physical dimensions, the angle of divergence of a diffuser and the rate of expansion of the fluid are therefore other factors which require optimization in order to design an efficient foam producing venturi.

U.S. Pat. No. 4,830,790, issued to Douglas E. Stevenson discloses two types of nozzles. The first one is a low expansion foam nozzle having apertured plate to promote turbulence in the fluid at the entry of the throat. The air injector holes are located partly on a convergent section of the throat. The nozzle has a tubular diffuser intended to increase throw distance of the foam rather than maximizing foam expansion.

The second nozzle disclosed by Stevenson is a medium expansion foam nozzle. The nozzle has also a tubular diffuser. The injector holes are placed near the larger end of the divergent section, and therefore at some distance from the minimum pressure region. In this embodiment, the apertured plates serve both purposes of a turbulence enhancer and a throat orifice.

U.S. Pat. No. 5,054,688, issued to John R. Grindley discloses another low expansion nozzle having venturi type orifices, radial injector openings and a tubular diffuser.

The disclosed foam nozzles as well as other models available commercially, having tubular diffusers may be somewhat efficient where the reach of the material from the nozzle is more important than ideal foam expansion.

Moreover, previous foam nozzles for medium expansion were found to operate satisfactorily only within a very narrow range of supply pressure, typically from 75 to 95 psi.

This narrow operational pressure range of commercial medium expansion nozzles represents a substantial inconvenience for fire fighting applications. A fire truck can generally deliver pressures of over 300 psi, and firemen arriving at a burning site usually do not have the time to regulate the hose pressure to accommodate the nozzle requirement. Adding the complication of pressure losses from several lengths of hoses, or from the elevation of the nozzle, the ideal pressure conditions may sometimes become difficult to obtain.

Furthermore, it is not a common practice to "choke" valves during a fire fighting operation. Consequently, the pressure setting for commercial medium expansion foam nozzles is widely ignored, and the aeration of the foaming agent is not always optimum. It is therefore common to spray a foam which has the texture of pearly white water, which dissipates rapidly, and which drips without having performed as anticipated while using an inordinate amount of foaming agent.

The low performance of the existing nozzles outside the pressure range they are capable of handling may be due to area/pressure ratio, location and size of injector openings, and the dimensions of the diffuser.

Thermodynamics and fluid mechanics indicate that the friction of the fluid against the wall of the diffuser, and the rapid expansion of an aerated mixture can create a compression zone within the diffuser. A compression zone has the adverse effect of saturating the expansion process, causing the foam to condense before reaching the discharge end of the diffuser. Thus, the shape and dimensions of the diffuser becomes very important to avoid formation of such a compression region.

It will be evident that the venturi, according to the present invention, may be used in a host of applications where a voluminous and rich foam is desired or where a fluid required significant aeration. Examples of additional applications include foamable insulation distribution, distribution of detergents, absorbents, herbicides, insecticides, etc.

SUMMARY OF THE INVENTION

One object of the present invention is to provide an improved medium expansion foam producing venturi.

In accordance with another object of the present invention there is provided a venturi having a longitudinal axis suitable for producing a foam comprising in combination: flow divider means for dividing a main fluid stream from a supply thereof into a plurality of secondary streams; nozzle means in fluid communication with the flow divider means, the nozzle means having an inlet converging from the flow divider means to an outlet at a distal end thereof, the outlet having a cross-sectional area relative to the longitudinal axis; air induction means in fluid communication with the outlet of the nozzle means for drawing air into a fluid stream passing therethrough, the air induction means diverging from the outlet; and a hollow body having an inlet and an outlet extending from the air induction means.

The venturi arrangement, according to the present invention, in contrast to existing venturi arrangements, is quite tolerant of the fluid supply pressure and is capable of operating effectively within a broad pressure range.

A medium expansion foam producing venturi was tested thoroughly at fluid supply pressures ranging from 35 psi to 350 psi, and with foaming agent/water mixture ratios of 0.1% to 1.0%. The venturi, according to the present invention, consistently produced coherent and voluminous foam throughout the entire test range. The consequences of those results are that the new venturi can be installed and used hastily by firemen of all skills, without any form of adjusting instructions.

It is known that the air absorption characteristics of a fluid flowing in a turbulent mode are substantially better than a fluid flowing in a laminar mode. The flow divider means cooperates with the converging nozzle to improve subsequent aeration of the mixture by generating turbulence through the throat of the nozzle. It has been found that a flow divider means capable of inducing a counterclockwise swirl is yet a further improvement in the nozzle.

The outlet section of the nozzle has a generous divergence, extending to define a relatively large nozzle exit area. A frustum shaped diffuser extends therefrom to further define a larger discharge area.

The volume defined by the divergent section and the entry of the diffuser provides a relatively large region of lower pressure to admit air. The air injector openings are advantageously located to connect with this low pressure region.

Proper angle of divergence on this diffuser substantially reduces the build-up of a compression zone before the discharge end. Where reach may be important, the frustoconical diffuser may be somewhat less conical.

A double thickness conical screen within the diffuser assists in expanding larger bubbles into a homogeneous finer structured foam having improved coherence and longer drain time.

In accordance with a further object of the present invention, there is provided in a venturi having a longitudinal axis and suitable for producing a foam, the venturi having an inlet and an outlet, the improvement wherein the venturi includes: an air induction member coaxially disposed and mounted in fluid communication with the outlet of the nozzle, the induction member for drawing air into proximity of a fluid passing therethrough; a hollow frustoconical body having an outlet and an inlet, the body being mounted in a coaxial relationship with the air induction member, the venturi decreasing in cross-sectional area from the frustoconical body to the nozzle outlet whereby upon passage of a foamable mixture through the venturi, foam expansion is maximized.

The design and arrangement of the components therein, associated with the finding of appropriate nozzle and diffuser coefficients have led to the invention of this venturi, producing foam of improved characteristics over a wide range of supply pressures.

Having thus generally described the invention, reference will now be made to the accompanying drawings illustrating preferred embodiments.

DETAILED DESCRIPTION OF THE PREFERRED EMBODIMENTS

Figure 1:
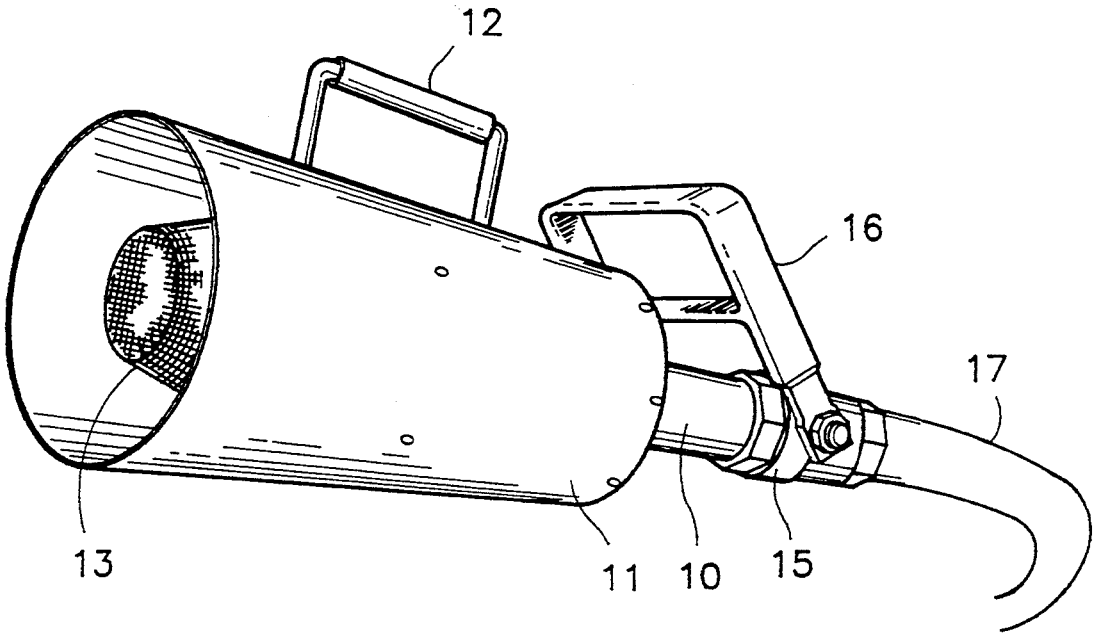
FIG. 1 is a perspective view of the new foam producing venturi, assembled on a typical ball valve and a fire hose.

In general overview with reference to FIG. 1, the foam producing venturi comprises a nozzle 10, a diffuser 11 and a foam breakup screen 13. The venturi is normally connected to a valve 15 and mounted, for example, at the end of a fire fighting hose 17. The venturi is manipulated by holding handle 12 with one hand and the valve 15 with the other hand. A valve handle 16 controls the flow of foaming agent/water mixture, and thus controls the operation of the invention. The arrangement of the valve handle 16, requiring a forward motion to open the valve 15 prevents accidental opening of the venturi when it is pulled through a wooded area to reach a burning site.

Figure 2:
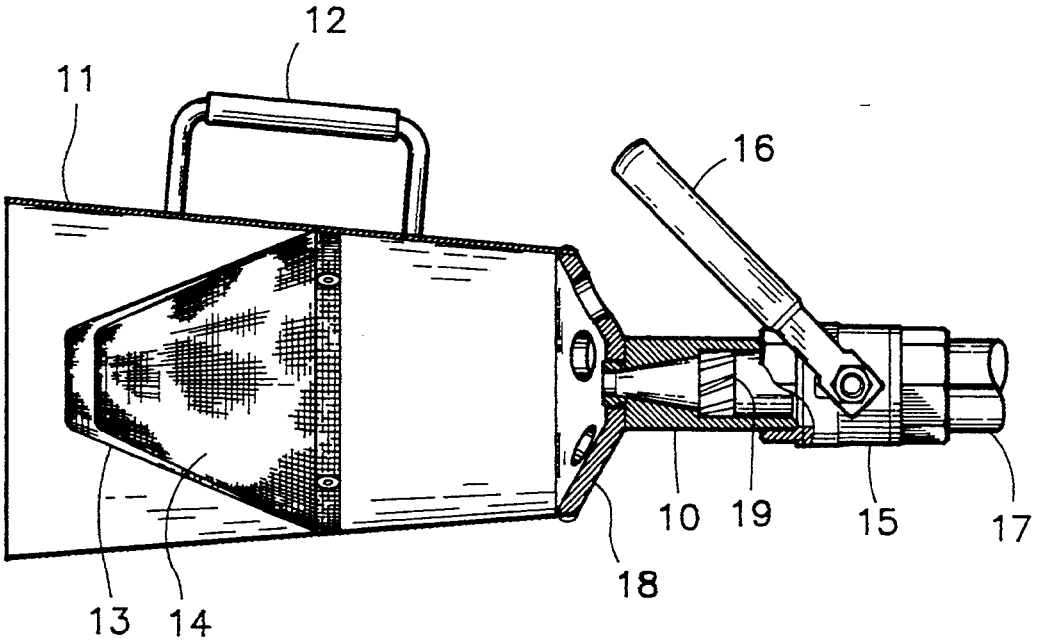
FIG. 2 is a longitudinal cross-section of the diffuser and the nozzle.
Figure 3:
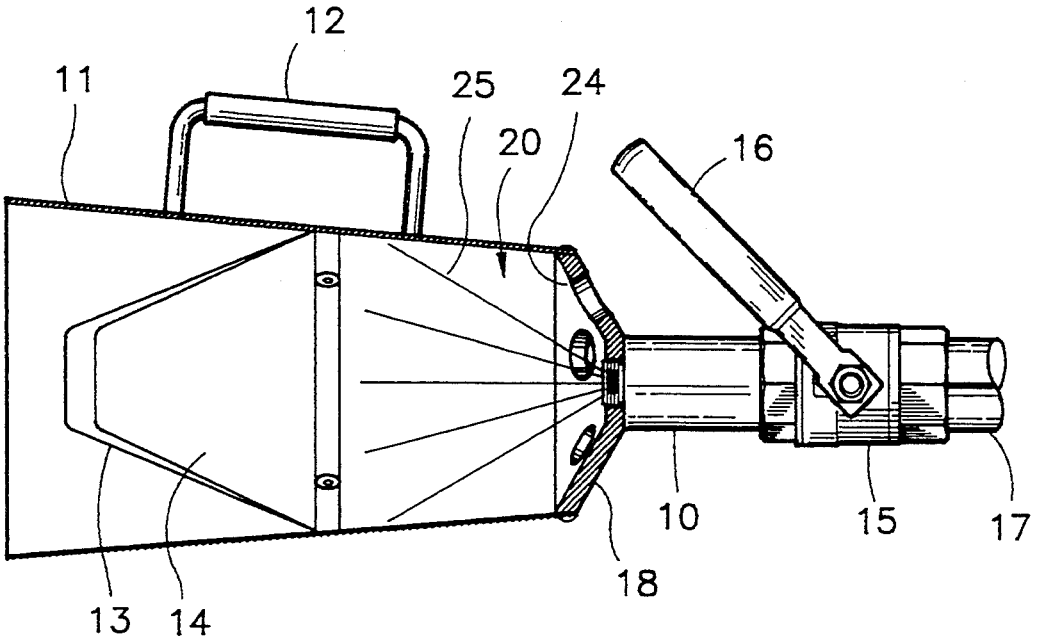
FIG. 3 is the low pressure region around the envelope of the spray.

Referring to FIGS. 2 and 3, the foam producing venturi further includes a second foam breakup screen 14 mounted coaxially within and in a longitudinally spaced outer screen 13. A diverging air induction plate 18 and a flow divider for dividing a supply stream into a plurality of streams is provided in the form of a swirl inducing bushing 19; the latter element is mounted at the entry of the convergent section 23 of the venturi 10.

Figure 4:
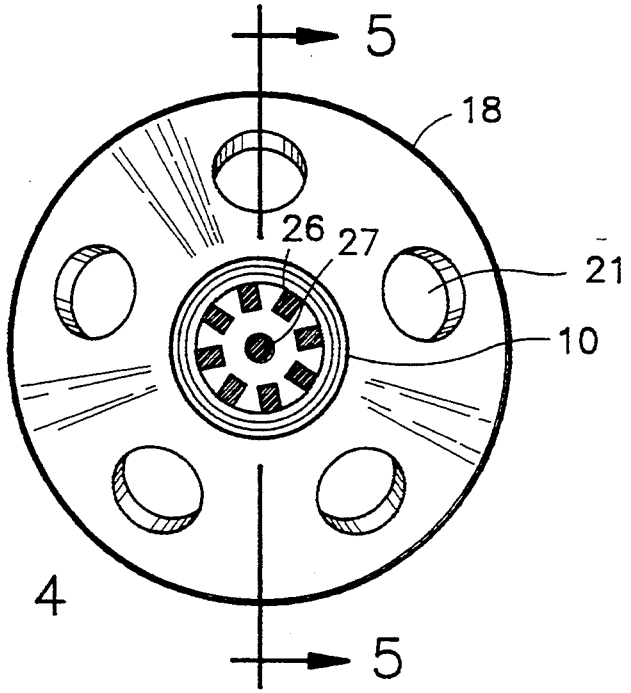
FIG. 4 is a plan view of the injector plate.
Figure 5:
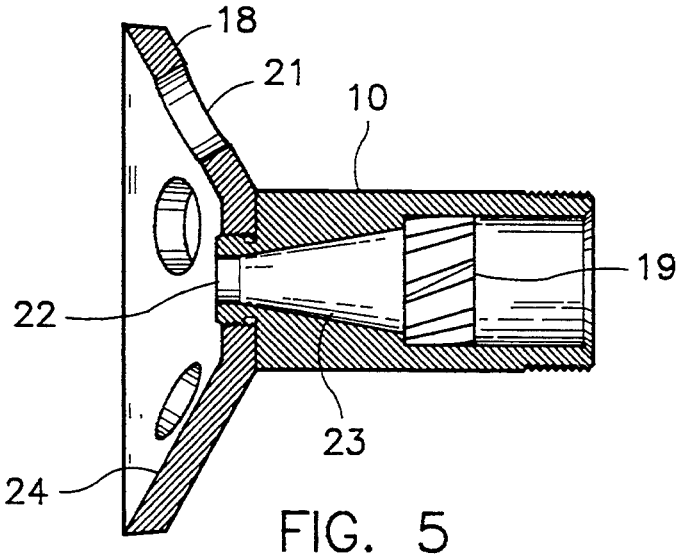
FIG. 5 is a cross-section view of the nozzle and injector plate along line 5—5 of FIG. 4.

As illustrated in FIGS. 4 and 5, the elements of the nozzle have a circular cross-section relative to the longitudinal axis of the venturi. The area of the cross-sections of the elements including diffuser 11 (shown in FIG. 2) progressively decreases from diffuser 11 to a throat 22 of nozzle 10. This feature assists in the effectiveness of the apparatus and will be discussed in greater detail hereinafter.

The restriction created by the concentric screens 13 and 14 expands the foam into a homogeneous and coherent structure which has improved water retention characteristics, and thus has a longer dwell period.

The function of bushing 19 is to generate a vortex at the entrance of the convergent section of the nozzle 23 and within the throat 22, as it can be seen on FIG. 5. The turbulence created thereby combined with the fluid expansion occurring at the exit of throat 22 ensures improved air absorption characteristics to the fluid.

Referring back to FIGS. 2 and 3, while referring to FIGS. 4 and 5, the area of the plane defined by the internal circumference of the distalmost edge of the injector plate 18 is also important to the expansion of the fluid at the exit of the throat 22. This area coefficient, generally defined as exit area/throat area, was found to produce ideal performance when at values of between about 100/1 to 150/1 were employed. Similarly, the area defined by the opening of the discharge end of the diffuser 11 is important to avoid the formation of a compression zone within the diffuser. The diverting angle of the diffuser was found to satisfy fluid expansion for a wide range of supply pressure, when established at 3° to 9°.

The air injector uses the kinetic energy of a fluid to introduce air in this fluid from a region of low pressure, the location of the air injector holes 21 is important to good operation of the venturi. The volume defined by the intersection of the surface of the divergent section 24, by the envelope of the spray 25 and by the inside surface of the diffuser 11 represents the low pressure volume 20. The lowest pressure in a venturi system being at the exit end of the throat 22, the air injector holes 21 are located within the divergent section 24 of the venturi. Concurrently with other values, a ratio for air injector holes area/throat area of between 15/1 and 30/1 gave superior performance of the new foam producing venturi.

Furthermore, the substantial size of the low pressure volume 20, associated with controlled air entrance and a divergent diffuser 11 prevents any drowning effect on the air injector which may be caused by a backing-up compression zone within the diffuser 11 and/or by an excessive supply pressure.

Figure 6:
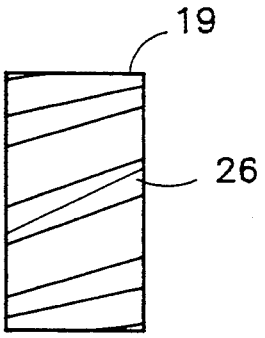
FIG. 6 is a side view of the swirl inducer bushing.
Figure 7:
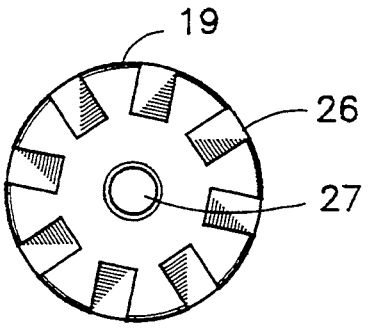
FIG. 7 is a plan view of the swirl inducer bushing.

The swirl inducer bushing 19 is rigidly fitted inside the nozzle 10, before the convergent section 23, as it can be seen in FIG. 5. FIGS. 6 and 7 further illustrate the longitudinal grooves 26 and a central hole 27 on the swirl inducer bushing 19.

The total area represented by the sum of the cross-section of hole 27 plus the sum of the portion of all cross-section of grooves 26 aligning within the divergent section 23, is defined as the swirl bushing opening area. A ratio of this area divided by the throat area giving value of 1.1/1 to 2.0/1 is preferred.

One possible embodiment of the new venturi associated with the results thereabove has the following dimension angles and area coefficients;

| | Operational Range |
|---|---|
| (Angle relative to the longitudinal axis of the nozzle) | |
| Entry angle-convergent section | 8°–12° |
| Exit angle-divergent section | 40°–70° |
| Entry angle, injector openings | 25°–35° |
| Discharge angle-conical diffuser | 3°–9° |
| Groove angle-swirl inducer | 15°–25° |
| (Coefficient Ratios) | |
| Injector opening/throat area | 15/1 –30/1 |
| Exit area/throat area | 100/1 –150/1 |
| Flow divider member/throat area | 1.1/1 –2.0/1 |

The natural tendency for liquids to produce counterclockwise swirl in vertical pipes in the northern hemisphere has worthwhile effects in furthering turbulence in an oblique conduit as well. Therefore, the angular orientation of grooves 26 as well. Therefore, the angular orientation of grooves 26 relative to the longitudinal axis of the nozzle to produce a counterclockwise vortex is also preferred.

This description of the invention as a fire fighting foam producing venturi, shall not constitute a limitation in the scope of its applications. The invention also applies to the expansion and aeration of other fluids such as herbicides, insecticides, surfactants, detergents, absorbents, and applications of the like.

Although embodiments of the invention have been described above, it is not limited thereto and it will be apparent to those skilled in the art that numerous modifications form part of the present invention insofar as they do not depart from the spirit, nature and scope of the claimed and described invention.

We claim:

1. A method for producing medium expansion foam with a venturi having an inlet and an outlet, said venturi including a nozzle and a diffusing body, comprising the steps of:

inducing a swirling motion in a fluid containing a foaming agent and water;

accelerating said fluid through said nozzle;

expanding said fluid into a foam at said outlet of said nozzle within said diffusing body, said body having a cross-section area substantially larger than a cross-section of said outlet of said nozzle;

injecting air into said foam adjacent said outlet;

further expanding said foam in said diffuser; and breaking up said foam through a screen into a finer, coherent and voluminous texture.

2. The method as claimed in claim 1, wherein said fluid is introduced into said nozzle at a pressure from between 35 psi to about 350 psi.

3. The method as claimed in claim 1, wherein said fluid includes from between 0.1% to about 1.0% of said foaming agent by volume.

4. A venturi having a longitudinal axis suitable for producing a foam comprising in combination:

flow divider means for dividing a main fluid stream from a supply thereof into a plurality of secondary streams;

nozzle means in fluid communication with said flow divider means, said nozzle means having an inlet converging from said flow divider means to an outlet at a distal end thereof, said outlet having a cross-sectional area relative to said longitudinal axis;

air induction means having an area dimension and being in fluid communication with said outlet of said nozzle means for drawing air into a fluid stream passing therethrough, said air induction means diverging from said outlet, said area of said air induction means relative to said area of said outlet being from 100:1 to about 150:1; and a hollow body having an inlet and an outlet extending from said air induction means.

5. The venturi as claimed in claim 4, wherein said hollow body comprises a frustoconical body.

6. The venturi as claimed in claim 4, wherein said flow divider means comprises a bushing including a plurality of grooves therein for dividing a main fluid stream.

7. The venturi as claimed in claim 6, wherein said grooves are angularly inclined relative to a longitudinal axis of said bushing.

8. The venturi as claimed in claim 7, wherein said inclination is between 15° to about 25°.

9. The venturi as claimed in claim 4, wherein said nozzle means, said air induction means and said hollow body are arranged in a coaxial relationship.

10. The venturi as claimed in claim 9, wherein each of said nozzle means, air induction means and said hollow body has a circular cross-section relative to a longitudinal axis of said venturi.

11. The venturi as claimed in claim 10, wherein each said cross-section of said air induction means and hollow body decreases in area from a maximum at said outlet of said hollow body to a minimum at said outlet of said nozzle means.

12. The venturi as claimed in claim 11, wherein a ratio of cross-sectional area of said air induction means relative to a cross-sectional area of said outlet of said nozzle means is between about 100:1 and 150:1.

13. The venturi as claimed in claim 11, wherein a ratio of cross-sectional area of said outlet of said hollow body relative to a cross-sectional area of said outlet of said nozzle means is between 200:1 to about 250:1.

14. In a venturi having a longitudinal axis and suitable for producing a foam, said venturi having an inlet and an outlet, the improvement wherein said venturi includes a nozzle having an area dimension:

an air induction member having an area dimension coaxially disposed and mounted in fluid communication with said outlet of said nozzle, said induction member for drawing air into proximity of a fluid passing therethrough the area of said air induction member relative to said area of said outlet means being in a ratio of from 100:1 to about 150:1; and a hollow frustoconical body having an outlet and an inlet, said body being mounted in a coaxial relationship with said air induction member, said venturi decreasing in an upstream direction in cross-sectional area from a downstream end of said frustoconical body to said nozzle outlet whereby upon passage of a foamable mixture through said venturi, foam expansion is maximized.

15. The venturi as claimed in claim 14, wherein said air induction member diverges from said nozzle at an angle from about 40° to about 70° relative to said longitudinal axis.

16. The venturi as claimed in claim 14, wherein said air induction member includes a central aperture in communication with said nozzle outlet and a plurality of secondary apertures surrounding said central apertures.

17. The venturi as claimed in claim 16, wherein said secondary apertures are angularly inclined relative to said longitudinal axis.

18. The venturi as claimed in claim 17, wherein said inclination is between 25° to about 35°.

19. The venturi as claimed in claim 14, wherein said frustoconical body diverges from said air induction member at an angle of about 3° to about 9° relative to said longitudinal axis.

20. The venturi as claimed in claim 19, wherein said frustoconical body defines a discharge area, said discharge area being in a ratio of 200:1 to 250:1 relative to said outlet area of said nozzle.

21. The venturi as claimed in claim 14, wherein said frustoconical body includes screen means therein for further dividing a foam passing therethrough.

22. The venturi as claimed in claim 21, wherein said screen means comprises a plurality of longitudinally spaced concentric screens.

23. The venturi as claimed in claim 14, wherein said nozzle includes a flow divider means for dividing a main fluid stream from a supply thereof into a plurality of secondary streams.

24. The venturi as claimed in claim 23, wherein said flow divider means comprises a bushing, said bushing having a plurality of grooves therein for dividing a main fluid stream.

25. The venturi as claimed in claim 24, wherein said grooves are angularly inclined relative to a longitudinal axis of said bushing.

26. The venturi as claimed in claim 25, wherein said inclination is between 15° to about 25°.

* * * * *